US008364066B2

(12) United States Patent
Nakamura et al.

(10) Patent No.: US 8,364,066 B2
(45) Date of Patent: Jan. 29, 2013

(54) IMAGE FORMING APPARATUS INCLUDING A FIXING APPARATUS WITH REGULATION MEMBER

(75) Inventors: Hirokazu Nakamura, Osaka (JP); Kousuke Namisaki, Osaka (JP); Takashi Yamanaka, Osaka (JP); Kimihide Tsukamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 701 days.

(21) Appl. No.: 12/540,499

(22) Filed: Aug. 13, 2009

(65) Prior Publication Data

US 2010/0046995 A1 Feb. 25, 2010

(30) Foreign Application Priority Data

Aug. 20, 2008 (JP) ..... 2008-212031

(51) Int. Cl.
*G03G 15/20* (2006.01)

(52) U.S. Cl. ..... 399/328; 399/330; 399/331; 219/216

(58) Field of Classification Search ..... 399/328, 399/330, 331; 219/216
See application file for complete search history.

(56) References Cited

U.S. PATENT DOCUMENTS

| | | | | |
|---|---|---|---|---|
| 4,104,963 | A * | 8/1978 | Fortmann | 100/176 |
| 4,235,166 | A * | 11/1980 | Tsunoi | 100/158 R |
| 6,411,785 | B1 * | 6/2002 | Ogawahara et al. | 399/69 |
| 6,580,894 | B1 * | 6/2003 | Kobashigawa | 399/329 |
| 6,961,533 | B2 * | 11/2005 | Sano et al. | 399/330 |
| 7,107,001 | B2 * | 9/2006 | Kameda | 399/328 |
| 7,684,746 | B2 * | 3/2010 | Asakura et al. | 399/330 |
| 7,783,218 | B2 * | 8/2010 | Maeda et al. | 399/69 |
| 7,953,360 | B2 * | 5/2011 | Kagawa | 399/328 |
| 8,099,034 | B2 * | 1/2012 | Tsukamoto et al. | 399/328 |
| 8,233,831 | B2 * | 7/2012 | Nakayama et al. | 399/327 |
| 8,280,286 | B2 * | 10/2012 | Condello et al. | 399/320 |
| 2007/0212085 | A1 * | 9/2007 | Mitsuya et al. | 399/45 |
| 2007/0217838 | A1 * | 9/2007 | Yamana et al. | 399/328 |
| 2008/0003009 | A1 * | 1/2008 | Minakuchi et al. | 399/69 |
| 2009/0324307 | A1 * | 12/2009 | Tsukamoto et al. | 399/328 |

FOREIGN PATENT DOCUMENTS

| | | |
|---|---|---|
| JP | 2000-347528 | 12/2000 |
| JP | 2005-241785 | 9/2005 |
| JP | 2005-241922 | 9/2005 |
| JP | 2005-258135 | 9/2005 |

* cited by examiner

*Primary Examiner* — David Gray
*Assistant Examiner* — Geoffrey Evans
(74) *Attorney, Agent, or Firm* — Renner, Otto, Boisselle & Sklar, LLP

(57) ABSTRACT

A fixing apparatus 12 in one embodiment of the present invention includes a fixing roller 31, a pressure roller 32, a pressing apparatus 100 for pressing the pressure roller 32 toward the fixing roller 31, a pressure cancellation apparatus 200 that cancels pressure applied by the pressing apparatus 100 to the pressure roller 32 against the fixing roller 31, an external heating apparatus 300 that presses the fixing roller 31 from the outside on an opposite side to the pressure roller 32, and a regulation member 400 that regulates the amount of pressure the external heating apparatus 300 applies to the fixing roller 31.

8 Claims, 10 Drawing Sheets

IMAGE FORMING APPARATUS INCLUDING A FIXING APPARATUS WITH REGULATION MEMBER

CROSS-REFERENCE TO RELATED APPLICATIONS

This application claims priority under 35 U.S.C. §119(a) on Patent Application No. 2008-212031 filed in Japan on Aug. 20, 2008, the entire contents of which are herein incorporated by reference.

BACKGROUND OF THE INVENTION

The present invention relates to a fixing apparatus that can be applied in an image forming apparatus such as a copying machine, a facsimile machine, or a printer, and also relates to an image forming apparatus including that fixing apparatus.

In an image forming apparatus of this type, for example when an electrophotographic method is adopted, an electrostatic latent image is formed on the surface of an image carrier such as a photosensitive drum. The electrostatic latent image on the surface of the image carrier is developed using developer, and a toner image is thereby formed on the surface of the image carrier. The toner image is transferred from the image carrier onto a recording sheet, and the recording sheet is heated and pressed to fix the toner image onto the recording sheet.

A fixing apparatus fixes a toner image on a recording sheet. That is, the fixing apparatus is normally provided with a pressing means for pressing a pressure roller toward a fixing roller. A recording sheet is transported while sandwiched in a nip region between a fixing roller and a pressure roller. Accordingly, the recording sheet is heated and pressed by the rollers, so that toner on the recording sheet is heated and melted so as to be fixed.

With such a conventional fixing apparatus, depending on the type of a recording sheet to be transported, pressure between the rollers may influence the state of a recording sheet when the sheet passes through a nip region. For example, when fixing is performed on a thick recording sheet formed pouch-like such as an envelope with pressure suitable for fixing on standard plain paper, a transport irregularity such as a wrinkle may occur.

In view of avoiding the occurrence of an irregularity in transporting a recording sheet such as an envelope as described above, a conventional fixing apparatus is provided with a pressure cancellation means that cancels pressure applied by a pressing means to a pressure roller against a fixing roller; thus, an appropriate pressure is obtained by the pressure cancellation means cancelling the pressure between the rollers as necessary (for example, see JP 2005-258135A).

On the other hand, there are also cases in which a fixing apparatus is provided with an external pressing means that presses a fixing roller from the outside. For example, in view of improving the heating capability for a fixing roller, such as shortening of a warm-up time or temperature following, an external heating means that heats and presses a fixing roller from the outside is provided as an external pressing means.

Generally, a fixing roller is a member to be replaced when maintenance is performed, and often attached to a fixing apparatus body that supports both ends of a fixing roller shaft so as to be easily replaceable. For example, there are cases in which both ends of the fixing roller shaft are positioned and held such that the fixing roller is movable to the pressure roller side (correctly positioned and held using an elastic member, such as a plate spring, such that the roller can be easily detached by a person such as an operator, for example), so that the fixing roller can be easily attached to or detached from a support member of the fixing apparatus body (for example, a member such as a lateral plate). By adopting such a configuration, it is possible to easily perform the work of replacing a fixing roller.

When a fixing apparatus including a pressing means that presses a pressure roller toward a fixing roller, a pressure cancellation means that cancels pressure applied by the pressing means to the pressure roller against the fixing roller, and an external pressing means that presses the fixing roller from the outside has a configuration in which the external pressing means presses the fixing roller from an opposite side to the pressure roller, and further the fixing roller is allowed to move to the pressure roller side, a problem as described below may occur.

That is, since the configuration allows the fixing roller to move toward the pressure roller side while the external pressing means presses the fixing roller from an opposite side to the pressure roller, when the pressure cancellation means cancels pressure applied by the pressure roller against the fixing roller, the fixing roller moves toward the pressure roller side due to a pressing force applied by the external pressing means. Consequently, the pressure between the fixing roller and the pressure roller that is expected to be appropriately cancelled is stronger than the pressure that should be cancelled, which causes an irregularity in transporting a recording sheet such as an envelope, for example.

SUMMARY OF THE INVENTION

Consequently, it is an object of the present invention to provide a fixing apparatus in which even when a pressure cancellation unit cancels pressure applied by a pressure roller against a fixing roller, it is possible to suppress the movement of the fixing roller toward the pressure roller side due to an external pressing unit, thus enabling the occurrence of an irregularity in transporting a recording sheet such as an envelope, for example, to be suppressed, and also to provide an image forming apparatus including that fixing apparatus.

In order to address the above problem, the present invention provides a fixing apparatus including a fixing roller, a pressure roller, a pressing unit for pressing the pressure roller toward the fixing roller, a pressure cancellation unit that cancels pressure applied by the pressing unit to the pressure roller against the fixing roller, an external pressing unit that presses the fixing roller from outside on an opposite side to the pressure roller, and a regulation member that regulates the amount of pressure the external pressing unit applies to the fixing roller, and an image forming apparatus including that fixing apparatus.

Here, the external pressing unit pressing "the fixing roller from outside on an opposite side to the pressure roller" refers to the external pressing unit pressing the fixing roller from a half-circumference face region on an opposite side to the pressure roller with an imaginary straight line as a border. Such imaginary straight line is orthogonal to another imaginary straight line passing through a rotational center on the axis of the fixing roller and a rotational center on the axis of the pressure roller, and passes through the rotational center of the fixing roller.

In the fixing apparatus of the present invention, the external pressing unit may be provided as an external heating apparatus which includes a plurality of support rollers arranged parallel to the axial of the fixing roller, heat sources provided inside at least one of the plurality of support rollers, a heat belt stretched between these support rollers and a second pressing unit that presses the support rollers toward the fixing roller.

Also, the regulation member may be configured with an engaging member provided on the external heating apparatus and a latching member provided on the fixing apparatus body, here the engaging member engages the latching member in a state of making contact with each other.

Alternatively, the regulation member may be configured with a latching member provided on the external heating apparatus and an engaging member provided on the fixing apparatus body, here the latching member engages the engaging member in a state of making contact with each other.

In the configuration described above, the engaging member is preferably a protruding member that protrudes outward arranged parallel to the axial of the fixing roller.

Further, in the configuration described above, the second pressing unit may comprise a side frame rotatably supporting the support rollers, the side frame is swingably supported around a pivotal shaft that is provided in the external heating apparatus and parallel to the axial of the fixing roller, and the protruding member is located on an imaginary straight line that passes through the pivotal shaft and the rotational center of the fixing roller.

In the fixing apparatus and the image forming apparatus according to the present invention, when the pressure cancellation unit cancels pressure applied by the pressure roller against the fixing roller, the regulation member can regulate the amount of pressure the external pressing unit applies to the fixing roller. Thus, even with a configuration that allows the fixing roller to move toward the pressure roller side, when the pressure cancellation unit cancels pressure applied by the pressure roller against the fixing roller, the regulation member can restrict the fixing roller from moving toward the pressure roller side due to the external pressing unit. Consequently, pressure between the fixing roller and the pressure roller can be made appropriate; thus, it is possible to suppress the occurrence of an irregularity in transporting a recording sheet such as an envelope, for example.

As described above, with the fixing apparatus and the image forming apparatus including that fixing apparatus according to the present invention, even when the pressure cancellation unit cancels pressure applied by the pressure roller against the fixing roller, the regulation member can suppress the movement of the fixing roller toward the pressure roller side due to the external pressing unit. Therefore, it is possible to suppress the occurrence of an irregularity in transporting a recording sheet such as an envelope, for example.

DESCRIPTION OF THE PREFERRED EMBODIMENTS

Hereinafter, an embodiment of the present invention will be described with reference to the drawings. It should be noted that the embodiment below is a specific example of the present invention, and is not of a nature that limits the technical scope of the present invention.

Figure 1:
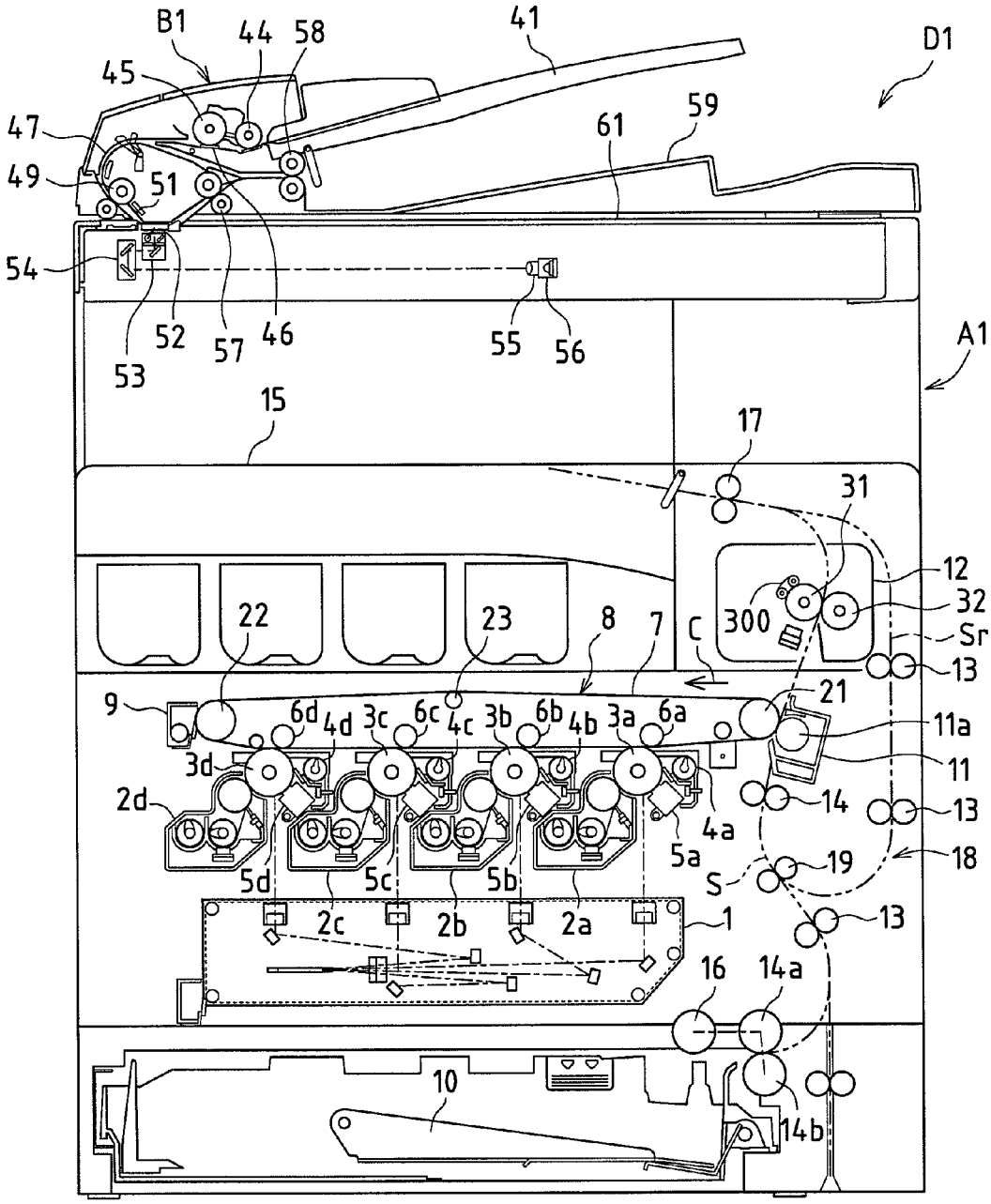
FIG. 1 is a side view schematically showing an image forming apparatus to which an embodiment of a fixing apparatus according to the present invention has been applied.

FIG. 1 is a side view schematically showing an image forming apparatus D1, to which an embodiment of a fixing apparatus according to the present invention has been applied. The image forming apparatus D1 includes an original reading apparatus B1 that reads an original image, and an apparatus main body A1 that records and forms, on a recording sheet such as paper in color or in a single color, an original image read by the original reading apparatus B1 or an image received from outside.

In the original reading apparatus B1, when originals are set on an original setting tray 41, a pickup roller 44 is pressed against the surface of the originals and rotated. Then, the originals are drawn out from the original setting tray 41 and passed between a separator roller 45 and a separation pad 46 so as to be individually separated. Thereafter, the originals are transported to a transport path 47.

In the transport path 47, a leading edge of an original abuts against registration rollers 49 so as to be aligned parallel to the registration rollers 49. Thereafter, the original is transported by the registration rollers 49 and passes between a reading guide 51 and a reading glass 52. At this time, light from a light source of a first scanning unit 53 is irradiated onto the surface of an original via the reading glass 52, and the reflected light is made to fall incident to the first scanning unit 53 via the reading glass 52. Then, the reflected light is reflected by mirrors of the first scanning unit 53 and a second scanning unit 54 and led to an imaging lens 55. An image of the surface of the original is formed on a CCD (Charge Coupled Device) 56 by the imaging lens 55. The CCD 56 reads the image on the surface of the original and outputs image data indicating the image on the surface of the original. Further, the original is transported by transport rollers 57 and discharged onto a discharge tray 59 via discharge rollers 58.

Also, an original placed on an original stage glass 61 can be read. The registration rollers 49, the reading guide 51, the discharge tray 59, and the like, and members disposed above these elements are integrated so as to form a cover body that is pivotably supported so as to be capable of opening/closing around an axis in the direction of transporting an original on a back side of the original reading apparatus B1. When this cover body provided in the upper part is opened, the original stage glass 61 is released, and an original can be placed on the original stage glass 61. When an original is placed thereon and the cover body is closed, with the first scanning unit 53 and the second scanning unit 54 being moved in the sub scanning direction, the first scanning unit 53 exposes the surface of the original on the original stage glass 61, the first scanning unit 53 and the second scanning unit 54 lead reflected light from the surface of the original to the imaging lens 55, and the image on the surface of the original is formed on the CCD 56 by the imaging lens 55. At this time, the first scanning unit 53 and the second scanning unit 54 are moved while maintaining a predetermined speed relationship with each other. Also, the positional relationship between the first scanning unit 53 and the second scanning unit 54 is always maintained in order not to change the length of the optical path of the reflected light (the surface of an original→the first scanning unit 53 and the second scanning unit 54→the imaging lens 55→the CCD 56). Consequently, focus of an image of the surface of an original on the CCD 56 is always accurately maintained.

The entire original image read in this way is transmitted to/received by the apparatus main body A1 of the image forming apparatus D1 as image data, and recorded onto a recording sheet in the apparatus main body A1.

On the other hand, the apparatus main body A1 of the image forming apparatus D1 includes an exposing apparatus 1, development apparatuses 2 (2*a*, 2*b*, 2*c*, and 2*d*), photosensitive drums 3 (3*a*, 3*b*, 3*c*, and 3*d*) that function as image carriers, charging units 5 (5*a*, 5*b*, 5*c*, and 5*d*), cleaner apparatuses 4 (4*a*, 4*b*, 4*c*, and 4*d*), an intermediate transfer belt apparatus 8 including intermediate transfer rollers 6 (6*a*, 6*b*, 6*c*, and 6*d*) that function as transfer units, a fixing apparatus 12, a sheet transport apparatus 18, a paper feed tray 10 that functions as a paper feed unit, and a discharge tray 15 that functions as a discharge unit.

Image data handled in the apparatus main body A1 of the image forming apparatus D1 corresponds to a color image using black (K), cyan (C), magenta (M), and yellow (Y), or corresponds to a monochrome image using a single color (for example, black). Accordingly, four units of each of the development apparatuses 2 (2*a*, 2*b*, 2*c*, and 2*d*), the photosensitive drums 3 (3*a*, 3*b*, 3*c*, and 3*d*), the charging units 5 (5*a*, 5*b*, 5*c*, and 5*d*), the cleaner apparatuses 4 (4*a*, 4*b*, 4*c*, and 4*d*), and the intermediate transfer rollers 6 (6*a*, 6*b*, 6*c*, and 6*d*) are provided in order to form four types of images corresponding to each color. Four image stations are configured with, among the respective suffix reference signs a to d, a corresponding to black, b corresponding to cyan, c corresponding to magenta, and d corresponding to yellow. The suffix reference signs a to d are omitted from the description below.

The photosensitive drums 3 are disposed substantially in the center of the apparatus main body A1 in the vertical direction.

The charging unit 5 is a charging means for uniformly charging the surface of the photosensitive drum 3 to a predetermined electric potential. Other than a contact roller-type charging unit or a contact brush-type charging unit, a charger-type charging unit is used.

Here, the exposing apparatus 1 is a laser scanning unit (LSU) including a laser diode and a reflection mirror, and exposes the surface of the charged photosensitive drum 3 in accordance with image data, and forms an electrostatic latent image on the surface thereof in accordance with the image data.

The development apparatuses 2 develop electrostatic latent images formed on the photosensitive drums 3 using a toner (K, C, M, and Y). The cleaner apparatuses 4 remove and collect residual toner on the surface of the photosensitive drums 3 after developing and transferring images.

The intermediate transfer belt apparatus 8 disposed above the photosensitive drums 3 includes an intermediate transfer belt 7, an intermediate transfer belt drive roller 21, an idler roller 22, a tension roller 23, and an intermediate transfer belt cleaning apparatus 9, in addition to the intermediate transfer rollers 6.

The intermediate transfer belt 7 is stretched between and supported by roller members such as the intermediate transfer belt drive roller 21, the intermediate transfer rollers 6, the idler roller 22, and the tension roller 23, which allow the intermediate transfer belt 7 to circulate in the predetermined sheet transport direction (the direction of arrow C in FIG. 1).

The intermediate transfer rollers 6 are rotatably supported inside the intermediate transfer belt 7, and pressed against the photosensitive drums 3 via the intermediate transfer belt 7.

The intermediate transfer belt 7 is provided so as to be in contact with the photosensitive drums 3. A toner image on the surface of each of the photosensitive drums 3 is sequentially superimposed and transferred onto the intermediate transfer belt 7 so as to form a color toner image (toner images of each color). Here, the transfer belt 7 is formed as an endless belt, using a film having a thickness of approximately 100 μm to 150 μm.

A toner image is transferred from the photosensitive drums 3 to the intermediate transfer belt 7 by the intermediate transfer rollers 6, which are pressed against the inner side (reverse face) of the intermediate transfer belt 7. In order to transfer the toner images, a high voltage transfer bias (for example, a high voltage with the opposite polarity (+) to the charge polarity (−) of the toner) is applied to the intermediate transfer rollers 6. Here, the intermediate transfer rollers 6 use a metal (stainless steel, for example) shaft with a diameter of 8 to 10 mm as a base, and the surface thereof is covered with conductive elastic material (such as EPDM or urethane foam, for example). With this conductive elastic material, it is possible to uniformly apply a high voltage to a recording sheet.

The apparatus main body A1 of the image forming apparatus D1 further includes a secondary transfer apparatus 11 including a transfer roller 11*a* that acts as a transfer unit. The transfer roller 11*a* is in contact with the outer side of the intermediate transfer belt 7.

As described above, the toner images on the surface of the photosensitive drums 3 are layered on the intermediate transfer belt 7 and become a color toner image indicated by image data. The toner images of each color layered in this way are transported together with the intermediate transfer belt 7 and transferred onto the recording sheet by the secondary transfer apparatus 11.

The intermediate transfer belt 7 and the transfer roller 11*a* of the secondary transfer apparatus 11 are pressed against each other to form a transfer nip region. Further, a voltage (for example, a high voltage with opposite polarity (+) to the charge polarity (−) of the toner) for transferring toner images of each color on the intermediate transfer belt 7 onto a recording sheet is applied to the transfer roller 11*a* of the secondary transfer apparatus 11. Furthermore, in order to constantly obtain the transfer nip region, either the transfer roller 11*a* of the secondary transfer apparatus 11 or the intermediate transfer belt drive roller 21 is made of a hard material (metal or the like), and the other is a roller made of a soft material, such as an elastic roller (elastic rubber roller, foam resin roller, or the like).

The secondary transfer apparatus 11 may not completely transfer a toner image on the intermediate transfer belt 7 onto a recording sheet, thus leaving toner on the intermediate transfer belt 7, so that the residual toner causes color toners to be mixed in the following processing. For this reason, the intermediate transfer belt cleaning apparatus 9 removes and collects residual toner. The intermediate transfer belt cleaning apparatus 9 includes, for example, a cleaning blade that is in contact with the intermediate transfer belt 7 as a cleaning member, and the cleaning blade can remove and collect residual toner. The intermediate transfer belt 7 is supported by the idler roller 22 from the inner side (reverse side), and the cleaning blade is in contact with the intermediate transfer belt 7 so as to press the idler roller 22 from the outside.

The paper feed tray 10 is a tray for storing recording sheets and is provided in the lower part of an image forming unit of the apparatus main body A1. Also, the discharge tray 15 provided in the upper part of the image forming unit is a tray on which a printed recording sheet is placed facedown.

Further, the apparatus main body A1 is provided with the sheet transport apparatus 18 for conveying a recording sheet on the paper feed tray 10 to the discharge tray 15 through the secondary transfer apparatus 11 and the fixing apparatus 12. The sheet transport apparatus 18 has an S-shaped sheet transport path S, and transport members such as a pickup roller 16, a separator roller 14*a*, a separation roller 14*b*, transport rollers 13, pre-registration rollers 19, registration rollers 14, the fixing apparatus 12, and discharge rollers 17 are disposed along the sheet transport path S. The fixing apparatus 12 will be described in detail later.

The pickup roller 16 is a draw-in roller that is provided on the downstream end of the paper feed tray 10 in the sheet transport direction and supplies recording sheets one-by-one from the paper feed tray 10 to the sheet transport path S. The separator roller 14*a* causes a recording sheet to pass between the separator roller 14*a* and the separation roller 14*b* so as to separate recording sheets one-by-one, and transports that recording sheet to the sheet transport path S. The transport rollers 13 and the pre-registration rollers 19 are small rollers for promoting and assisting transportation of a recording sheet. The transport rollers 13 are provided in a plurality of positions along the sheet transport path S.

The leading edge of the transported recording sheet bumps against the registration rollers 14 that are in a stopped state, so that the leading edge is aligned. Then, the registration rollers 14 transport the recording sheet in a timely manner, in synchronization with a toner image formed on the intermediate transfer belt 7 so that the toner image on the intermediate transfer belt 7 is transferred onto the recording sheet in the transfer nip region between the intermediate transfer belt 7 and the secondary transfer apparatus 11. For example, the registration rollers 14 transports a recording sheet so that a toner image on the intermediate transfer belt 7 comes to a position in which an image is to be formed on the recording sheet in the transfer nip region between the intermediate transfer belt 7 and the secondary transfer apparatus 11.

The fixing apparatus 12 receives a recording sheet on which a toner image has been transferred, and transports the recording sheet sandwiched between a fixing roller 31 and a pressure roller 32.

The recording sheet on which toner images of each color have been fixed is discharged by the discharge rollers 17 onto the discharge tray 15.

Note that it is also possible to form a monochrome image using only one of the four image forming stations and transfer the monochrome image onto the intermediate transfer belt 7 of the intermediate transfer belt apparatus 8. The monochrome image is transferred onto a recording sheet from the intermediate transfer belt 7 and fixed onto the recording sheet, similarly to a color image.

Further, when an image is formed not only on the front face of the recording sheet, but on both faces, after an image on the front face of the recording sheet has been fixed by the fixing apparatus 12, the discharge rollers 17 are stopped and then rotated in reverse while transporting the recording sheet by the discharge rollers 17 in the sheet transport path S, thereby causing the recording sheet to pass through a reverse path Sr. After the front and back of the recording sheet are reversed, the recording sheet is again led to the registration rollers 14. Similarly to the case of forming an image on the front face of the recording sheet, an image is recorded and fixed on the back face of the recording sheet, and the recording sheet is discharged onto the discharge tray 15.

Figure 2:
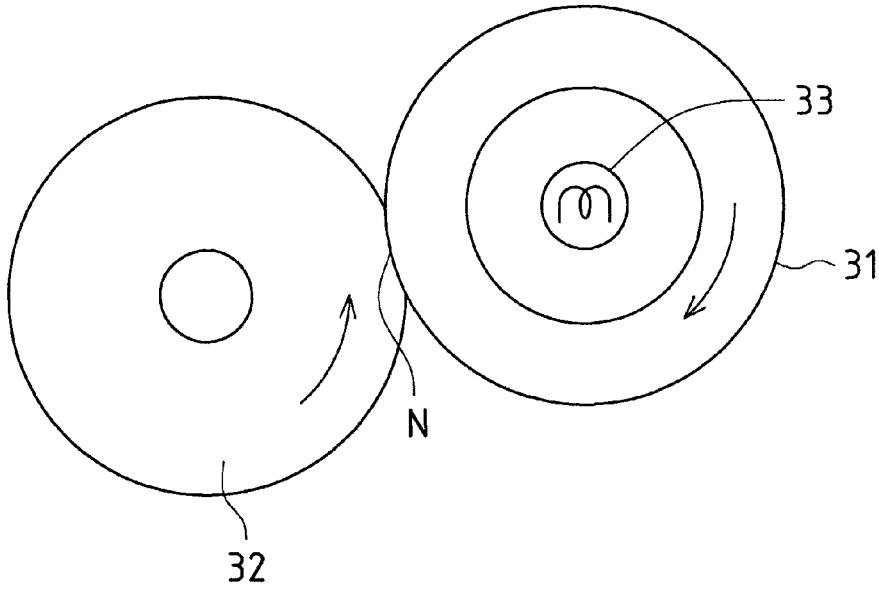
FIG. 2 is a schematic side view showing a state in which a pressure roller is pressed against a fixing roller in the fixing apparatus according to this embodiment.

FIG. 2 is a schematic side view showing a state in which the pressure roller 32 is pressed against the fixing roller 31 in the fixing apparatus 12 according to the present embodiment.

In the fixing apparatus 12 of the present embodiment, as shown in FIG. 2, a fixing nip region N is formed where a recording sheet is sandwiched between the fixing roller 31 and the pressure roller 32 in a state in which the pressure roller 32 is pressed against the fixing roller 31. The fixing roller 31 is driven to rotate in the direction of the arrow, with the pressure roller 32 being idly rotated. A recording sheet passes through the fixing nip region N and is heated and pressed. Thus, a toner image on the recording sheet is melted, mixed, and pressed, so that the toner image is thermally fixed onto the recording sheet.

Specifically, the fixing roller 31 is a roller having a three-layer structure in which an elastic layer is provided on an outer surface of a core metal and a mold release layer is formed on an outer surface of the elastic layer. For example, a metal such as iron, stainless steel, aluminum, or copper, or an alloy of these, can be used for the core metal. Furthermore, a silicon rubber can be used for the elastic layer, and a fluorocarbon resin such as PFA (tetrafluoroethylene-perfluoroalkylvinylether copolymer) or PTFE (polytetrafluoroethylene) can be used for the mold release layer.

A heat source (here, a halogen heat lamp) 33 for heating the fixing roller 31 is provided inside the fixing roller 31 (inside the core metal).

Similar to the fixing roller 31, the pressure roller 32 is a roller that also has a three-layer structure in which a core metal made of a metal such as iron, stainless steel, aluminum, or copper, or an alloy of these, an elastic layer made of a silicon rubber or the like on the surface of the core metal, and further still a mold release layer made of PFA, PTFE, or the like on the elastic layer are provided.

Here, for example, in order to avoid a transport irregularity such as a wrinkle from occurring due to pressure suitable for fixing onto standard plain paper when fixing is performed onto a thick recording sheet formed pouch-like such as an envelope, in the fixing apparatus 12 of the present embodiment, the pressure roller 32 is moved in the direction of cancelling pressure applied by the pressure roller 32 against the fixing roller 31 when the fixing roller 31 and the pressure roller 32 are stopped, so that it is possible to switch a pressing force between the fixing roller 31 and the pressure roller 32, between a predetermined first pressing force (for example, a pressing force for a recording sheet that is plain paper) and a predetermined second pressing force (for example, a pressing force for a recording sheet such as an envelope) that is weaker than the first pressing force.

Figure 3:
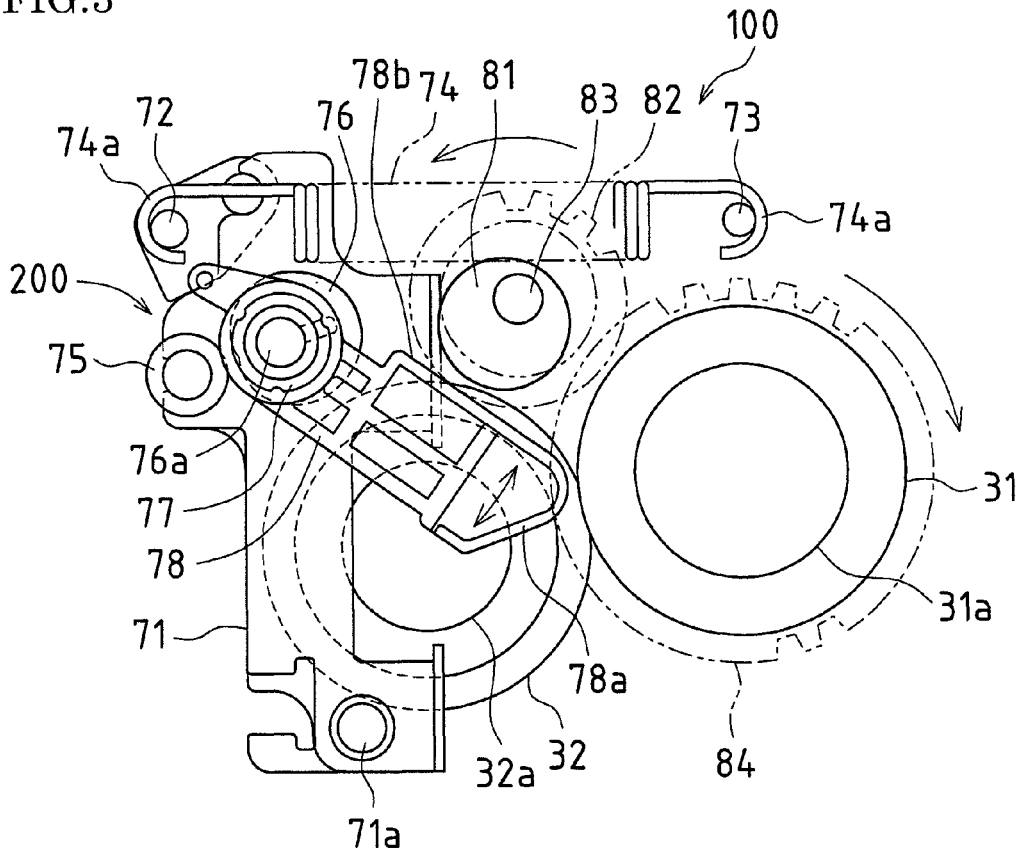
FIG. 3 is a schematic cross-sectional view showing the configuration of one end side of the fixing roller and the pressure roller in the axial direction in the fixing apparatus according to this embodiment.
Figure 4:
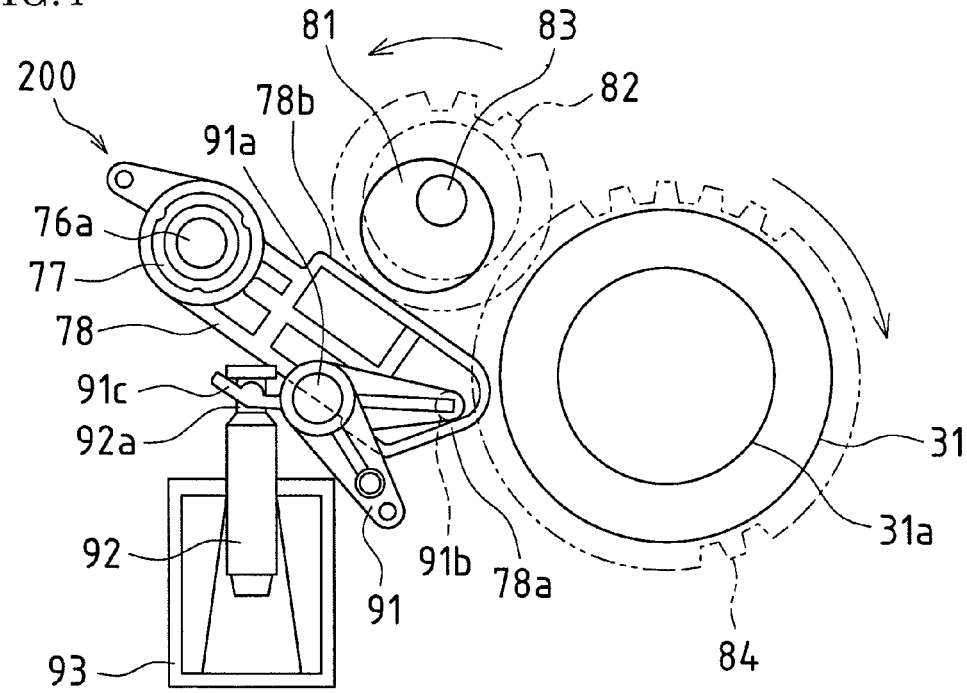
FIG. 4 is a schematic cross-sectional view showing the configuration of one end side of the fixing roller and the pressure roller in the axial direction in the fixing apparatus according to this embodiment, and is a diagram showing the configuration positioned further toward the outside than that shown in FIG. 3.

FIGS. 3 and 4 are schematic cross-sectional views showing the configuration of one end side of the fixing roller 31 and the pressure roller 32 in the axial direction in the fixing apparatus 12. The views shown in FIGS. 3 and 4 are sectioned at different positions, and the configuration shown in FIG. 4 is positioned further toward the outside than the configuration shown in FIG. 3.

As shown in FIGS. 3 and 4, the fixing apparatus 12 includes the fixing roller 31, the pressure roller 32, a pressing apparatus 100 that is an example of a pressing means that presses the pressure roller 32 toward the fixing roller 31, and a pressure cancellation apparatus 200 that is an example of a pressure cancellation unit that cancels pressure applied by the pressing apparatus 100 to the pressure roller 32 against the fixing roller 31. The fixing apparatus 12 sandwiches a recording sheet in the fixing nip region N between the fixing roller 31 and the pressure roller 32, and transports the recording sheet.

<Pressing Apparatus>

In the present embodiment, the pressing apparatus 100 includes a displacement support member (here, a displacement frame) 71 and a biasing member (here, a coil spring) 74. The fixing roller 31 is axially supported on a body frame (not shown in FIGS. 3 and 4, see reference numerals 79*a* and 79*b* in FIG. 8 described later) of the fixing apparatus 12 so as to be rotatable around its axis, and rotates by a rotational driving force provided by a driving source (not shown) being transmitted.

The displacement frame 71 axially supports the pressure roller 32 so that the roller is rotatable around its axis, and displaces in the direction of pressing the pressure roller 32 against the fixing roller 31 or in the direction of cancelling pressure applied by the pressure roller 32 against the fixing roller 31. Specifically, the displacement frame 71 supports a shaft 32*a* of the pressure roller 32 via a bearing (not shown), and is supported so as to be capable of swinging around a pivotably supported shaft 7 la (more specifically, the shaft 71*a* supported on the body frame of the fixing apparatus 12) in the axial direction of the pressure roller 32, with respect to the fixing apparatus 12 body.

Also, the displacement frame 71 is biased by the coil spring 74 in the direction of pressing the pressure roller 32 against the fixing roller 31. Specifically, hooks 74*a* on both ends of the coil spring 74 are respectively hooked around a pin 72 positioned on an outer side in a radial direction with the shaft 71*a* of the displacement frame 71 as the center and a pin 73 of the body frame. The pin 72 of the displacement frame 71 is pulled by the coil spring 74 toward the pin 73 of the body frame and, thereby, the displacement frame 71 is biased toward the fixing roller 31 side with the shaft 71*a* as the center. Pressure applied by the pressure roller 32 against the fixing roller 31 is the first pressing force.

<Pressure Cancellation Apparatus>

In the present embodiment, the pressure cancellation apparatus 200 includes a pressure cancellation cam (eccentric cam) 76, a one-way clutch 77, a swing lever 78, and a swing cam (eccentric cam) 81, and serves as an automatic pressure cancellation means that automatically switches between the first pressing force applied by the pressing apparatus 100 to the pressure roller 32 against the fixing roller 31 and the second pressing force obtained by cancelling the first pressing force.

The pressure cancellation cam 76 slidingly contacts the displacement frame 71. The one-way clutch 77 is provided to a shaft 76*a* of the pressure cancellation cam 76 in the axial direction of the pressure roller 32. The swing lever 78 is connected to the one-way clutch 77, and is biased so as to slidingly contact the swing cam 81. Further, the swing cam 81 rotates in one direction by a rotational driving force from a driving source (not shown) being transmitted.

In the pressure cancellation apparatus 200, when the swing cam 81 is rotated in one direction due to a rotational driving force from the driving source, the swing lever 78, which slidingly contacts the swing cam 81, repeatedly swings. Then, swinging of the swing lever 78 is transmitted via the one-way clutch 77 to the pressure cancellation cam 76 as intermittent rotation in one direction, and the pressure cancellation cam 76 pushes away the displacement frame 71, opposing a biasing force applied by the coil spring 74. The displacement frame 71 is displaced together with the pressure roller 32 so that pressure applied by the pressure roller 32 against the fixing roller 31 is cancelled and is changed from the first pressing force to the second pressing force.

Specifically, a roller 75 is provided on an outer side in a radial direction with the shaft 71*a* of the displacement frame 71 as the center. The shaft 76*a* is axially supported on the body frame of the fixing apparatus 12. The shaft 76*a* protrudes through an opening portion (not shown) of the displacement frame 71 disposed further toward the outside than the body frame. The pressure cancellation cam 76 is fixed on the shaft 76*a* in a position where the shaft protrudes. Further, the roller 75 provided on the displacement frame 71 is pressed against the pressure cancellation cam 76 by the pin 72 of the displacement frame 71 being pulled toward the pin 73 of the body frame by the coil spring 74.

The one-way clutch 77 is provided to the shaft 76*a* of the pressure cancellation cam 76. The swing lever 78 is fixedly connected to the one-way clutch 77. Here, the one-way clutch 77 is provided further toward the outside than the pressure cancellation cam 76 and parallel thereto in the axial direction. The one-way clutch 77 is interposed between the swing lever 78 and the shaft 76*a* of the pressure cancellation cam 76. Only rotation in the other direction (for example, the clockwise rotation in the drawings) of the swing lever 78 is transmitted to the shaft 76*a* via the one-way clutch 77. When the swing lever 78 rotates in one direction (for example, the counterclockwise rotation in the drawings), the one-way clutch 77 idles so that the rotation in that one direction is not transmitted to the shaft 76*a*.

The swing lever 78 is biased in the direction toward the swing cam 81 with the shaft 76*a* of the pressure cancellation cam 76 as the center by an unshown biasing means (for example, a spring).

A shaft 83 in the axial direction of the fixing roller 31 is supported on the body frame of the fixing apparatus 12 so as to be rotatable around its axis. The swing cam 81 and a swing gear 82 are axially supported by the shaft 83 such that relative rotation is not possible, and the swing gear 82 meshes with a drive gear 84 fixed on a shaft 31*a* of the fixing roller 31. Accordingly, by the fixing roller 31 being driven to rotate, the drive gear 84 rotates so that the swing gear 82 rotates together with the swing cam 81.

In FIG. 4, a control lever 91 is axially supported so as to be rotatable around a shaft 91*a* in the axial direction of the fixing roller 31 with respect to the body frame of the fixing apparatus 12. A pin 91*b* is provided on one end of the control lever 91 in a protruding manner facing inward in the axial direction of the fixing roller 31. The swing lever 78 is provided with a frame portion 78*a* that protrudes facing outward in the axial direction of the fixing roller 31 and extends along the peripheral edge. The pin 91*b* of the control lever 91 is positioned inside the frame portion 78*a*. That is, the frame portion 78*a* of the swing lever 78 is edged with a rib, so that the pin 91*b* on one end of the control lever 91 catches the rib.

A clamping unit 91*c* is provided in a protruding manner on an opposite side to the pin 91*b* with the shaft 91*a* of the control lever 91 therebetween. The clamping unit 91*c* is connected to a plunger 92 of a solenoid 93 disposed orthogonal to the shaft 91*a*. Specifically, the clamping unit 91*c* has an engaging unit that is "U" shaped as viewed from above on the end portion, and a constricted portion 92*a* of the plunger 92 is clamped in the U-shaped engaging unit. The plunger 92 is inserted in an opening provided in the solenoid 93 so as to be movable along the opening. When the solenoid 93 is in a non-operating state, the plunger 92 is biased by a spring (not shown) in the direction in which the plunger 92 protrudes so as to protrude from the solenoid 93. On the other hand, when the solenoid 93 is in an operating state, the plunger 92 is pulled inside the solenoid 93, opposing the biasing force applied by the spring.

FIG. 4 shows the state of the control lever 91 when the solenoid 93 is in a non-operating state. As shown in FIG. 4, when the solenoid 93 is in a non-operating state, the plunger 92 protrudes from the solenoid 93, and the clamping unit 91*c* of the control lever 91 that clamps the constricted portion 92*a* of the plunger 92 is pushed up. Then, the control lever 91 turns in the direction in which the pin 91*b* engages with the frame portion 78*a* of the swing lever 78 with the shaft 91*a* as the center, and the pin 91*b* engages with the frame portion 78*a*. That is, the pin 91*b* catches the inside of the frame portion 78*a* and turns the swing lever 78 in the direction separating from the swing cam 81, opposing the biasing force applied by a spring (not shown). Accordingly, a sliding contact edge 78*b* of the swing lever 78 that slidingly contacts the swing cam 81 separates from the outer circumferential surface of the swing cam 81.

As described above, in a state in which the sliding contact edge 78*b* of the swing lever 78 is separated from the outer circumferential surface of the swing cam 81, even when the fixing roller 31 is driven to rotate so that the drive gear 84 rotates, and the swing gear 82 rotates together with the swing cam 81, the stopped state of the swing lever 78 can be maintained.

Figure 5:
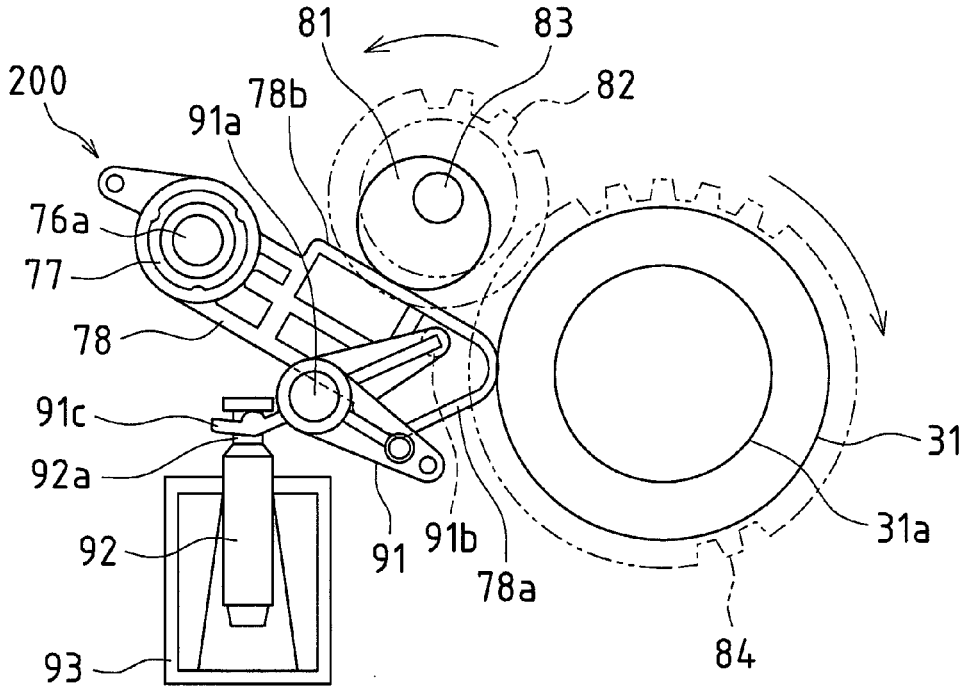
FIG. 5 is a diagram showing a state of a control lever when a solenoid is in an operating state in a pressure cancellation apparatus according to the fixing apparatus of this embodiment.

FIG. 5 is a diagram showing the state of the control lever 91 when the solenoid 93 is in an operating state in the pressure cancellation apparatus 200.

In FIG. 5, the solenoid 93 is in an operating state. When the plunger 92 is pulled inside the solenoid 93, the clamping unit 91*c* of the control lever 91 that clamps the constricted portion 92*a* of the plunger 92, is pulled down, and the control lever 91 turns in the direction of cancelling the engagement of the pin 91*b* with the frame portion 78*a* of the swing lever 78 with the shaft 91*a* as the center so that the engagement of the pin 91*b* with the frame portion 78*a* is cancelled. That is, the swing lever 78 turns due to a biasing force applied by a spring (not shown) with the shaft 76*a* of the pressure cancellation cam 76 as the center so as to come into contact with the swing cam 81. Accordingly, the sliding contact edge 78*b* of the swing lever 78 abuts against the outer circumferential surface of the swing cam 81.

In this state, when the fixing roller 31 is driven to rotate so that the drive gear 84 rotates, and the swing gear 82 rotates together with the swing cam 81, the sliding contact edge 78*b* of the swing lever 78 slides on the outer circumferential surface of the swing cam 81. As a result, the swing lever 78 swings around the shaft 76*a*.

Figure 6:
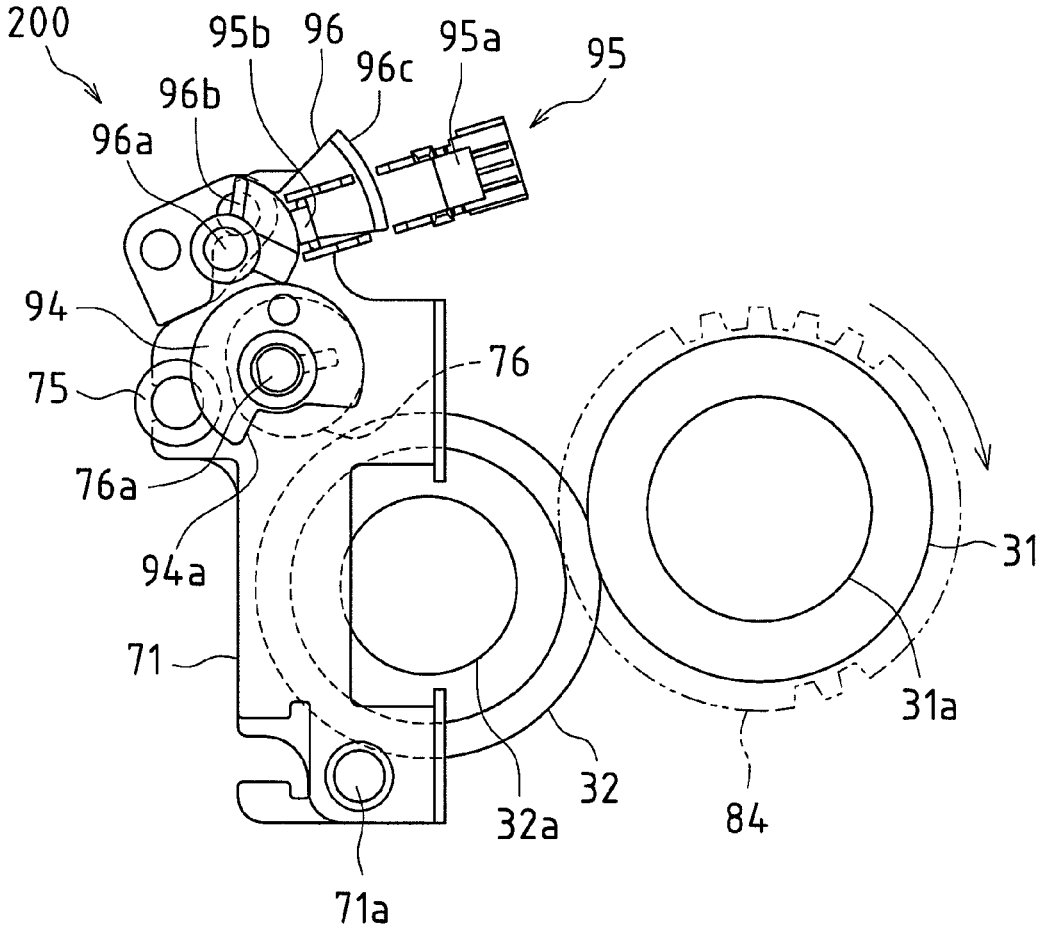
FIG. 6 is a schematic cross-sectional view showing the configuration of one end side of the fixing roller and the pressure roller in the axial direction in the fixing apparatus according to this embodiment, and a diagram showing a state in which the pressure roller is pressed against the fixing roller.
Figure 7:
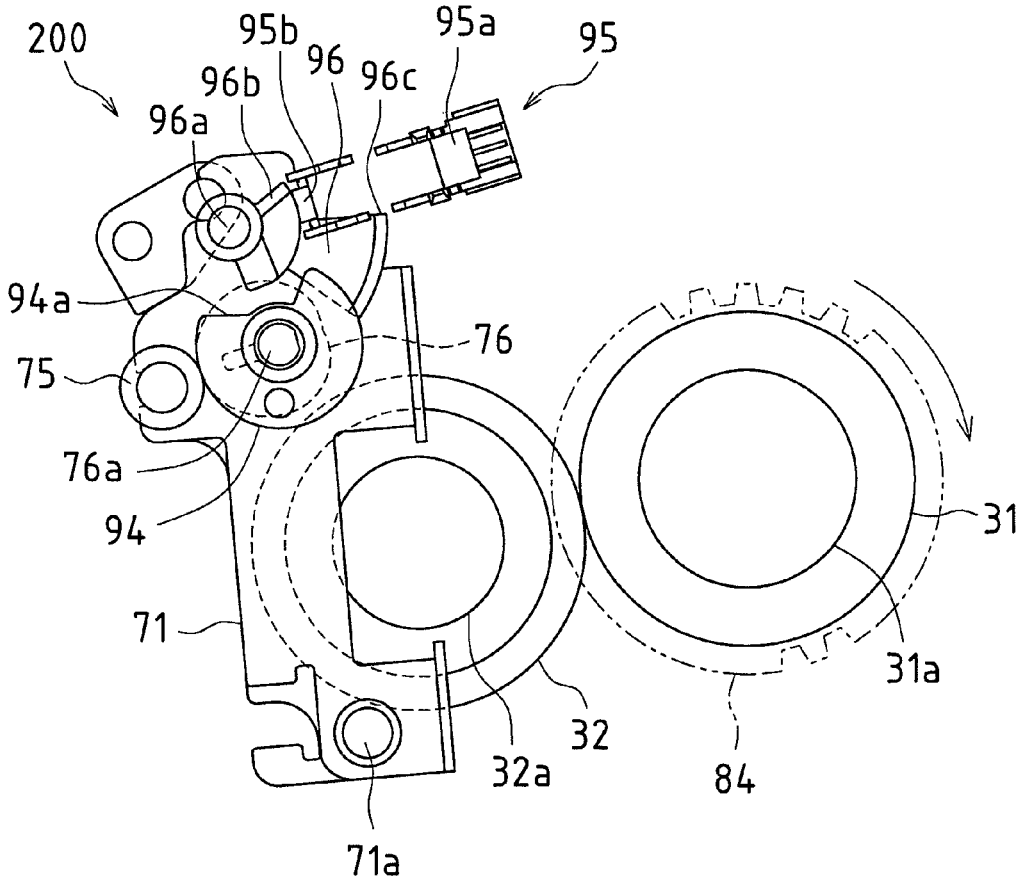
FIG. 7 is a schematic cross-sectional view showing the configuration of one end side of the fixing roller and the pressure roller in the axial direction in the fixing apparatus according to this embodiment, and a diagram showing a state in which pressure applied by the pressure roller against the fixing roller is cancelled.

FIGS. 6 and 7 are schematic cross-sectional views showing the configuration of one end side of the fixing roller 31 and the pressure roller 32 in the axial direction in the fixing apparatus 12. FIG. 6 is a diagram showing a state in which the pressure roller 32 is pressed against the fixing roller 31. FIG. 7 is a diagram showing a state in which pressure applied by the pressure roller 32 against the fixing roller 31 is cancelled. Note that FIGS. 6 and 7 show cross sections at a position further toward the outside than that of the cross section shown in FIG. 4.

As shown in FIG. 6, the pressure cancellation apparatus 200 further includes a cam 94 and a pressure control sensor 95.

The cam 94 is supported by the shaft 76*a* of the pressure cancellation cam 76 such that relative rotation is not possible. Accordingly, the cam 94 can rotate together with the shaft 76*a* of the pressure cancellation cam 76. Here, the cam 94 is provided further toward the outside than the one-way clutch 77 and the swing lever 78, and parallel thereto in the axial direction. The pressure control sensor 95 detects the position of the cam 94 in the circumferential direction, and furthermore, detects a pressure application state or a pressure cancellation state of the pressure roller 32 against the fixing roller 31 (that is, whether the pressure roller 32 is pressed against the fixing roller 31 with the first pressing force or with the second pressing force).

Specifically, the pressure control sensor 95 has a light emitting element 95*a* that emits light, a light receiving element 95*b* that receives light from the light emitting element 95*a*, and a detection member 96 configured so as to be capable of taking an incident position in which light from the light emitting element 95*a* is allowed to be incident to the light receiving element 95*b* and a blocking position in which light from the light emitting element 95*a* to the light receiving element 95*b* is blocked by displacing due to the rotation of the cam 94. The pressure control sensor 95 detects the position of the cam 94 in the circumferential direction by detecting the displacement of the detection member 96 using the light emitting element 95*a* and the light receiving element 95*b*.

More specifically, the cam 94 is a disk, in part of which a notch portion 94*a* is formed, and the detection member 96 of the pressure control sensor 95 is axially and rotatably supported by a shaft 96*a* in the axial direction of the pressure roller 32. The detection member 96 is provided with a fan-shaped sliding contact portion 96*b* on an inner side in a radial direction with the shaft 96*a* as the center, and is also provided with an arc wall portion 96*c* on an outer side in a radial direction with the shaft 96*a* as the center.

As shown in FIG. 6, when the outer circumferential surface on the short diameter side of the pressure cancellation cam 76 faces the roller 75, the notch portion 94*a* faces in the opposite direction to the sliding contact portion 96*b* of the detection member 96 with the shaft 76*a* therebetween. As a result, the outer circumferential surface of the cam 94 pushes up the sliding contact portion 96*b*, and the arc wall portion 96*c* of the detection member 96 moves to a position between the light emitting element 95*a* and the light receiving element 95*b* of the pressure control sensor 95, thereby blocking light irradiated from the light emitting element 95*a* to the light receiving element 95*b*.

On the other hand, as shown in FIG. 7, when the outer circumferential surface on the long diameter side of the pressure cancellation cam 76 is pressed against the roller 75, the notch portion 94*a* faces the sliding contact portion 96*b* of the detection member 96. As a result, the detection member 96 turns around the shaft 96*a* due to its own weight, and the sliding contact portion 96*b* moves into the notch portion 94*a* so that the arc wall portion 96*c* of the detection member 96 is brought out from between the light emitting element 95*a* and the light receiving element 95*b*, thus allowing the light emitting element 95*a* to irradiate the light receiving element 95*b* with light.

Consequently, based on the light receiving output from the light receiving element 95*b*, the pressure control sensor 95 can detect the position of the cam 94 in the circumferential direction and, furthermore, can detect whether the pressure roller 32 is pressed against the fixing roller 31 with the first pressing force or the second pressing force.

Figure 8:
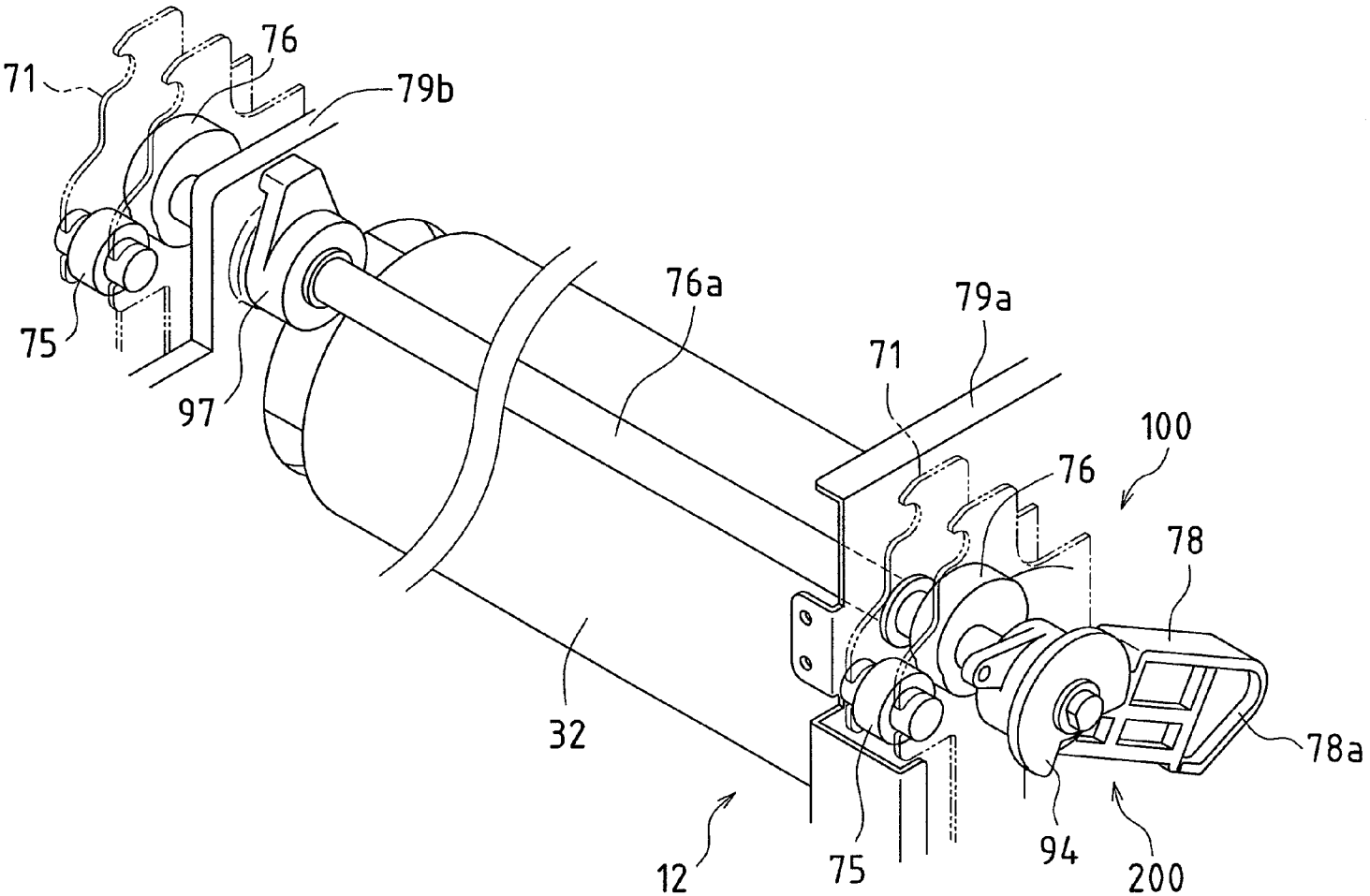
FIG. 8 is a perspective view schematically showing part of a pressing apparatus and the pressure cancellation apparatus in the fixing apparatus according to this embodiment.

FIG. 8 is a perspective view schematically showing part of the pressing apparatus 100 and the pressure cancellation apparatus 200 in the fixing apparatus 12.

As shown in FIG. 8, body frames 79*a* and 79*b* are disposed on both sides of the pressure roller 32, and both ends of the shaft 31*a* of the fixing roller 31 (omitted in FIG. 8) are axially supported on these body frames 79*a* and 79*b*. Also, the displacement frame 71 is disposed further toward the outside than one of the body frames, the body frame 79*a*. The displacement frame 71 is also disposed further toward the outside than the other body frame, the body frame 79*b*. Both ends of the shaft 32*a* of the pressure roller 32 protrude outside the body frames 79*a* and 79*b* so as to be axially supported on the respective displacement frames 71. The displacement frames 71 are biased by the coil spring 74 (omitted in FIG. 8) so that the pressure roller 32 is pressed against the fixing roller 31.

Also, a pressure cancellation cam 76 is provided to each of the body frames 79*a* and 79*b*, and a roller 75 that presses against the pressure cancellation cam 76 is provided on the displacement frame 71 side. The shaft 76*a* of the pressure cancellation cams 76 on both sides is one common shaft, and the pressure cancellation cams 76 on both sides rotate due to the rotation of the shaft 76*a*.

Moreover, a one-way clutch 97 for blocking reverse rotation is fixed inside the body frame 79*b*, and the shaft 76*a* of the pressure cancellation cam 76 is passed through the one-way clutch 97 for blocking reverse rotation. The one-way clutch 97 for blocking reverse rotation idles when the one-way clutch 77 on the body frame 79*a* side transmits rotation in the other direction to the shaft 76*a*, enabling the shaft 76*a* to rotate in the other direction. When the shaft 76*a* attempts to rotate due to the influence of the idling in one direction of the one-way clutch 77 on the body frame 79*a* side, the one-way clutch 97 prohibits the shaft 76*a* from rotating in one direction. Thus, the one-way clutch 77 on the body frame 79*a* side and the one-way clutch 97 for blocking reverse rotation fixed inside the body frame 79*b* transmit rotation and idle, in opposite directions.

<Operation Performed by Pressure Cancellation Apparatus>

When the fixing apparatus 12 as described above performs a fixing operation, as shown in FIG. 5, the solenoid 93 is put in an operating state so that the plunger 92 is pulled inside the solenoid 93. Consequently, the engagement of the pin 91*b* on one end of the control lever 91 with the frame portion 78*a* of the swing lever 78 is cancelled, the swing lever 78 turns toward the swing cam 81, and the swing lever 78 comes into contact with the swing cam 81 due to a biasing force applied by a spring (not shown). Accordingly, the sliding contact edge 78*b* of the swing lever 78 abuts against the outer circumferential surface of the swing cam 81.

Figure 9A:
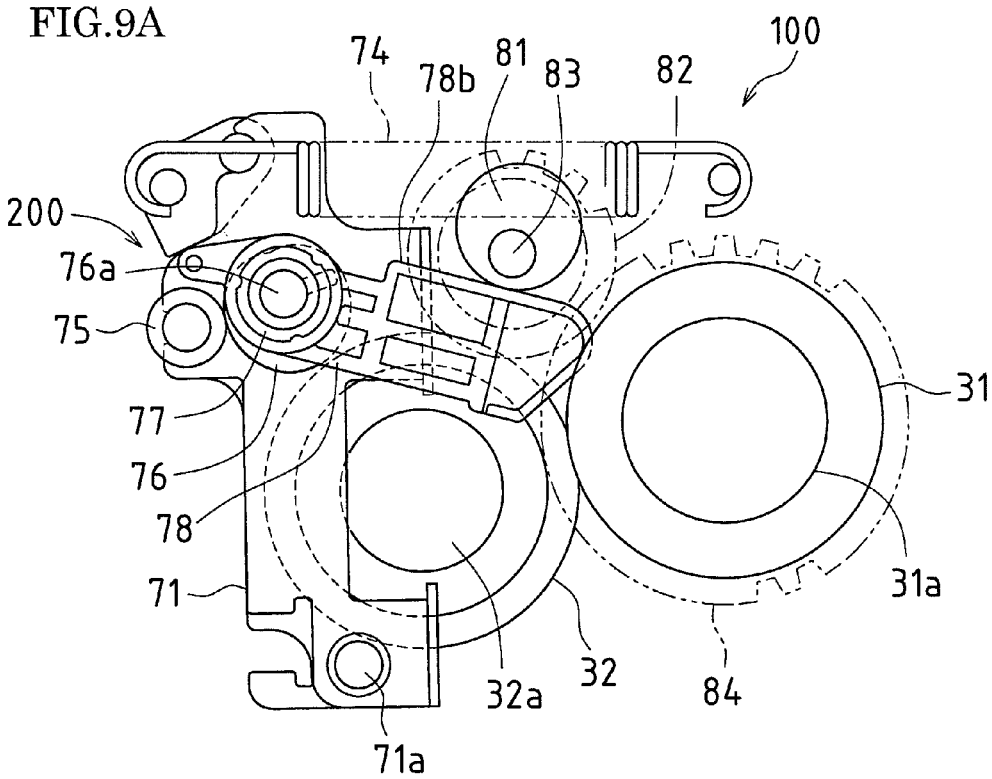
FIG. 9A is a diagram showing operation of a swing lever and a pressure cancellation cam in the fixing apparatus according to this embodiment, and is a diagram showing an operation to shift from a pressure application state with a first pressing force to a pressure cancellation state with a second pressing force of the pressure roller against the fixing roller.
Figure 9B:
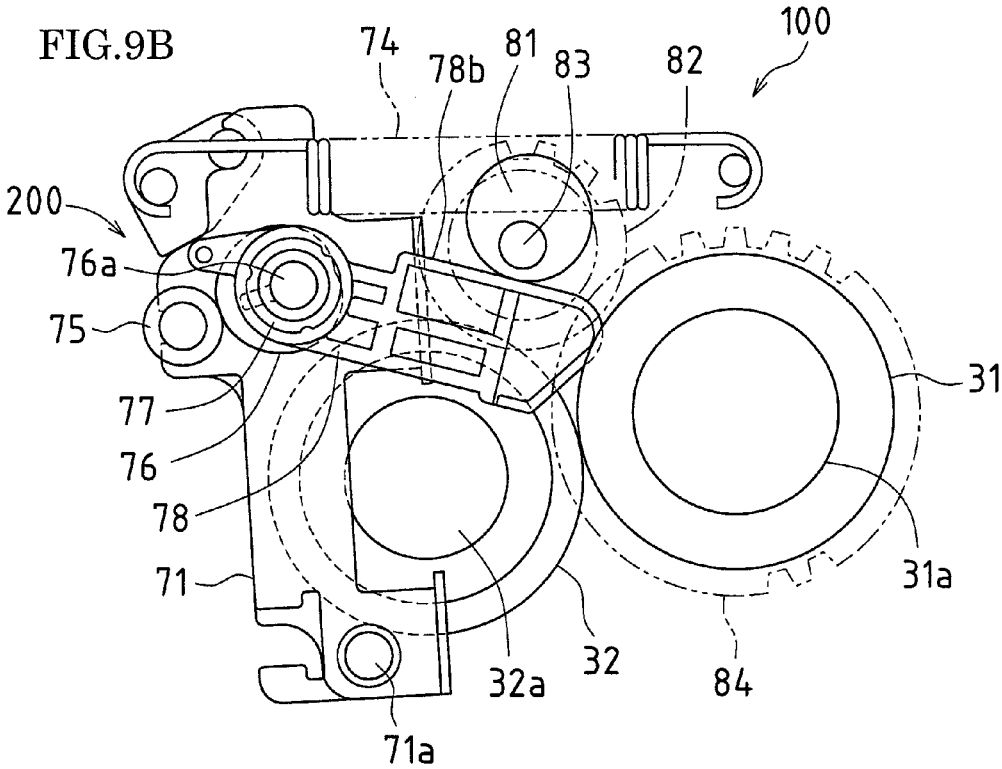
FIG. 9B is a diagram showing operation of the swing lever and the pressure cancellation cam in the fixing apparatus according to this embodiment, and is a diagram showing the pressure cancellation state of the pressure roller against the fixing roller with the second pressing force.

FIGS. 9A and 9B are diagrams showing operation of the swing lever 78 and the pressure cancellation cam 81. FIG. 9A shows an operation to shift from the pressure application state with the first pressing force to the pressure cancellation state with the second pressing force of the pressure roller 32 against the fixing roller 31. FIG. 9B shows the pressure cancellation state of the pressure roller 32 against the fixing roller 31 with the second pressing force.

When the fixing roller 31 is driven to rotate in a state in which the sliding contact edge 78*b* of the swing lever 78 abuts against the outer circumferential surface of the swing cam 81, the drive gear 84 rotates so that the swing gear 82 that meshes with the drive gear 84 rotates together with the swing cam 81, which causes the swing lever 78 to swing around the shaft 76*a*.

At this time, only the turns in the other direction of the swing lever 78 are transmitted to the shaft 76*a* of the pressure cancellation cam 76 via the one-way clutch 77; thus, the rotation in the other direction is intermittently transmitted to the shaft 76*a* of the pressure cancellation cam 76. As a result, as shown in FIG. 9A, the pressure cancellation cam 76 intermittently rotates in the other direction.

Meanwhile, when the swing lever 78 turns in one direction, and the one-way clutch 77 idles, the one-way clutch 97 for blocking reverse rotation on the body frame 79*b* side shown in FIG. 8 prohibits the shaft 76*a* of the pressure cancellation cam 76 from rotating in one direction. Consequently, the shaft 76*a* of the pressure cancellation cam 76 will not rotate in one direction due to the influence of the rotation in that one direction of the one-way clutch 77; thus, the pressure cancellation cam 76 intermittently and reliably rotates in the other direction.

(When Performing Fixing Operation on Plain Paper Recording Sheet)

When a fixing operation is performed on a recording sheet that is standard plain paper, as shown in FIG. 9A, the outer circumferential surface on the short diameter side of the pressure cancellation cam 76 faces the roller 75 of the displacement frame 71, and the pressure roller 32 presses against the fixing roller 31 with the first pressing force. At this time, as shown in FIG. 6, the notch portion 94*a* of the cam 94 faces the opposite direction to the sliding contact portion 96*b* of the detection member 96, and the outer circumferential surface of the cam 94 pushes up the sliding contact portion 96*b* of the detection member 96. Accordingly, the arc wall portion 96*c* of the detection member 96 moves to a position between the light emitting element 95*a* and the light receiving element 95*b* of the pressure control sensor 95, thereby blocking the incident light from the light emitting element 95*a* to the light receiving element 95*b*.

(When Performing Fixing Operation on Recording Sheet Such as Envelope)

On the other hand, when a fixing operation is performed on a thick recording sheet formed pouch-like such as an envelope, as shown in FIG. 9B, the outer circumferential surface on the long diameter side of the pressure cancellation cam 76 faces the roller 75 of the displacement frame 71, and the outer circumferential surface on the long diameter side of the pressure cancellation cam 76 pushes away the roller 75 of the displacement frame 71. The displacement frame 71 turns in the direction of separating from the fixing roller 31 with the shaft 71*a* thereof as the center, so that the pressure applied by the pressure roller 32 against the fixing roller 31 is switched from the first pressing force of to the second pressing force. At this time, as shown in FIG. 7, the arc wall portion 96*c* of the detection member 96 is brought out from between the light emitting element 95*a* and the light receiving element 95*b*, thus allowing the light emitting element 95*a* to irradiate the light receiving element 95*b* with light.

Here, when a fixing operation is performed, as shown in FIG. 4, the solenoid 93 is put in a non-operating state so that the plunger 92 protrudes from the solenoid 93, the plunger 92 pushes up the clamping unit 91*c* of the control lever 91, and the pin 91*b* on one end of the control lever 91 engages with the frame portion 78*a* of the swing lever 78. Accordingly, the swing lever 78 is turned in the direction of separating from the swing cam 81 by the pin 91*b*, so that the sliding contact edge 78*b* of the swing lever 78 separates from the outer circumferential surface of the swing cam 81.

At this time, although the drive gear 84 rotates together with the fixing roller 31 so that the swing gear 82 that meshes with the drive gear 84 rotates together with the swing cam 81, since the solenoid 93 is put in a non-operating state so that the swing lever 78 is separated from the outer circumferential surface of the swing cam 81, the state in which the swing lever 78 is stopped can be maintained.

In this state, the fixing roller 31 is driven to rotate so that the pressure roller 32 idly rotates. Then, a recording sheet such as plain paper or an envelope is caused to pass through the fixing nip region N between the fixing roller 31 and the pressure roller 32 so as to be heated and pressed. Accordingly, a fixing operation is performed by the fixing roller 31 and the pressure roller 32 in the pressure cancellation state on a recording sheet such as plain paper or an envelope.

<External Heating Apparatus>

The fixing apparatus 12 according to the present embodiment further includes an external heating apparatus 300 that is an example of an external pressing unit and presses the fixing roller 31 from the outside on an opposite side to the pressure roller 32.

Figure 10:
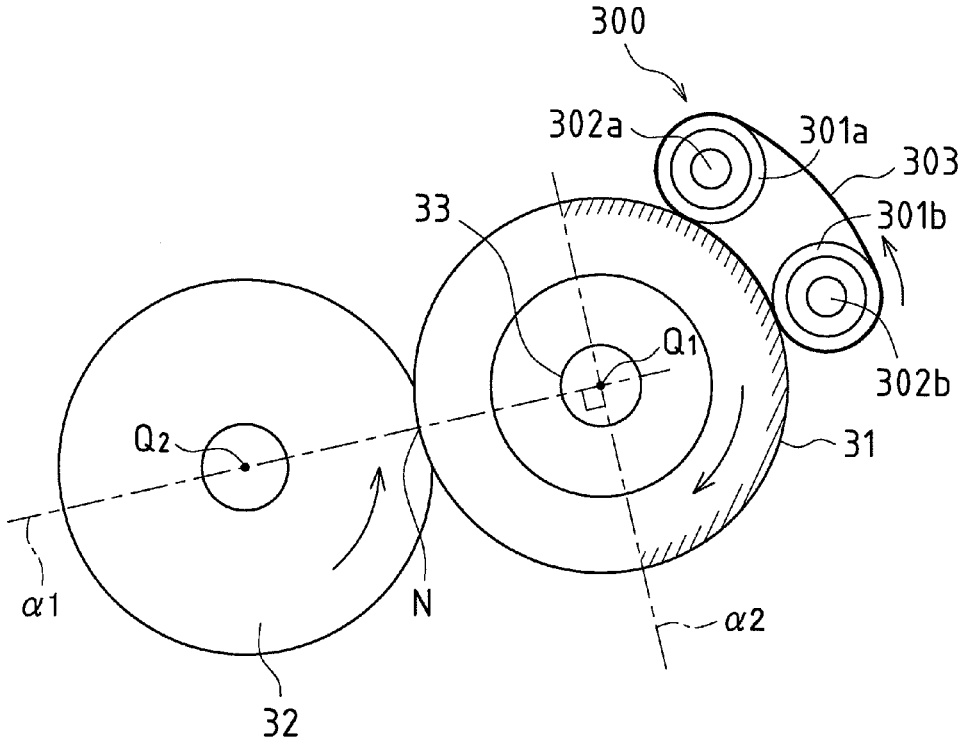
FIG. 10 is a side view schematically showing a state in which an external heating apparatus is pressing the fixing roller pressed by the pressure roller, from the outside on an opposite side to the pressure roller in the fixing apparatus according to this embodiment.

FIG. 10 is a side view schematically showing a state in which the external heating apparatus 300 is pressing the fixing roller 31 pressed by the pressure roller 32, from the outside on an opposite side to the pressure roller 32.

As shown in FIG. 10, the external heating apparatus 300 includes a plurality of (here, two) support rollers 301*a* and 301*b* arranged parallel to the axial of the fixing roller 31, heat sources 302*a* and 302*b* provided inside at least one of the plurality of support rollers 301*a* and 301*b* (here, both), a heat belt 303 stretched between these support rollers 301*a* and 301*b*, and a pressing apparatus 310 (omitted in FIG. 10, see FIGS. 11 and 12 described later) that acts as a pressing unit that presses the support rollers 301*a* and 301*b* toward the fixing roller 31. The external heating apparatus 300 causes the heat belt 303 heated by the heat sources 302*a* and 302*b* to abut against the outer circumferential surface of the fixing roller 31, and also heats the fixing roller 31 by the pressing apparatus 310 pressing from the opposite side to the pressure roller 32. Here, "pressing the fixing roller 31 from the opposite side to the pressure roller 32" refers to pressing the fixing roller 31 from a half-circumference face region (see diagonally shaded region in FIG. 10) on an opposite side to the pressure roller 32 with an imaginary straight line $\alpha 2$ as a border. The imaginary straight line $\alpha 2$ is orthogonal to an imaginary straight line $\alpha 1$ passing through a rotational center Q1 on the axis of the fixing roller 31 and a rotational center Q2 on the axis of the pressure roller 32, and passes through the rotational center Q1 of the fixing roller 31.

Specifically, the heat belt 303 is an endless belt, and is stretched between the support rollers 301*a* and 301*b* so that the reverse face (inner circumference face) abuts against the outer circumferential surface of the support rollers 301*a* and 301*b*. The support rollers 301*a* and 301*b* are pressed against the fixing roller 31 with a predetermined pressing force by the pressing apparatus 310 from the opposite side to the pressure roller 32, with the heat belt 303 between the support rollers 301*a* and 301*b* and the fixing roller 31.

Further, the heat belt 303 circulates following the fixing roller 31 by abutting against the outer circumferential surface of the rotating fixing roller 31. Accordingly, the support rollers 301*a* and 301*b* rotate in the opposite direction to the rotational direction of the fixing roller 31. That is, when the fixing roller 31 is driven to rotate, the heat belt 303 circulates following the fixing roller 31 due to a friction force in a portion in which the heat belt 303 and the fixing roller 31 are in contact, and the support rollers 301*a* and 301*b* idly rotate around their axes.

Figure 11:
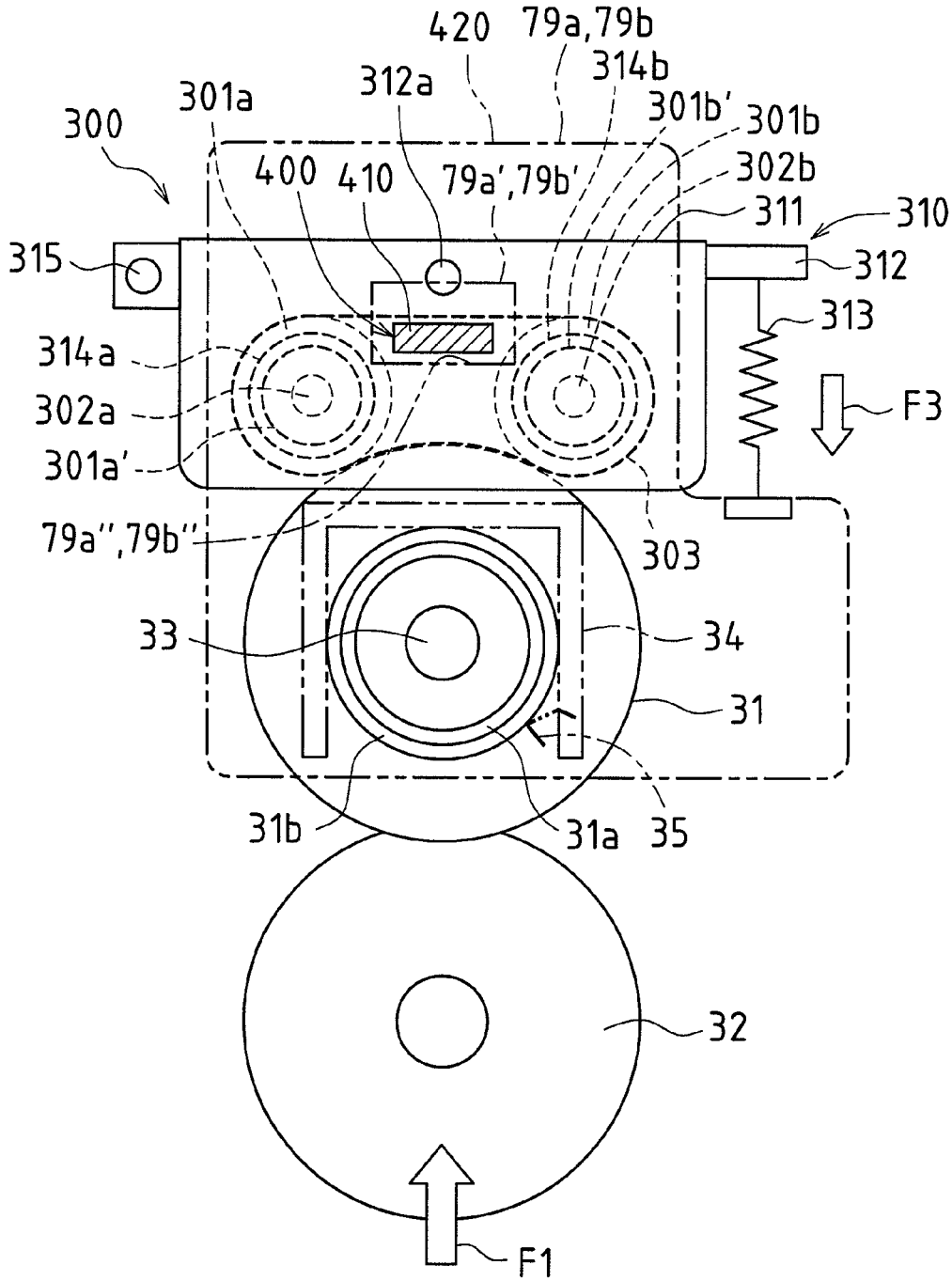
FIG. 11 is a schematic side view showing FIG. 10 in more detail.

FIG. 11 is a more detailed schematic side view than FIG. 10. Note that although the configuration of one end portion of the external heating apparatus 300 in the axial direction is shown in FIG. 11, the configurations of both end portions are similar to each other. Thus, the configuration of one end portion is shown here by way of example, and the configuration of the other end portion is omitted in FIG. 11. This also applies to FIG. 12 described later.

As shown in FIG. 11, the pressing apparatus 310 presses the support rollers 301*a* and 301*b* against the outer circumferential surface of the fixing roller 31 via the heat belt 303 with a predetermined pressing force F3.

The pressing apparatus 310 includes a side frame 311 that supports the support rollers 301*a* and 301*b* so that the rollers are rotatable around their axes, an arm 312 that supports the side frame 311 so that the frame can swing around a pivotal shaft 312*a* in the axial direction of the fixing roller 31, and also that is supported so as to be capable of turning around a pivotal shaft 315 in the axial direction of the fixing roller 31 with respect to the fixing apparatus 12 body, and a biasing member (here, a coil spring) 313 that biases the arm 312 toward the fixing roller 31.

Specifically, the side frame 311 rotatably supports shafts 301*a*' and 301*b*' on both ends of the support rollers 301*a* and 301*b* via bearings 314*a* and 314*b*, respectively. Note that the bearings 314*a* and 314*b* are disposed at predetermined intervals between shafts on the side frame 311 so as to retain parallelism of the support rollers 301*a* and 301*b* relative to each other.

Further, the side frame 311 is supported so as to be capable of swinging around the pivotal shaft 312*a* provided to the arm 312. Also, the arm 312 is supported so as to be capable of turning around the pivotal shaft 315 provided to the body frame of the fixing apparatus 12. One end of the coil spring 313 is connected to the arm 312, and the other end is connected to the body frames 79*a* and 79*b* of the fixing apparatus 12 so that the arm 312 is biased to the fixing roller 31 side.

The heat sources (here, halogen heat lamps) 302*a* and 302*b*, which generate heat using supplied electric power, are provided inside the support rollers 301*a* and 301*b*. The heat belt 303 is heated by the heat sources 302*a* and 302*b* via the support rollers 301*a* and 301*b* so as to be controlled to a predetermined temperature. The heat belt 303 heats the outer circumferential surface of the fixing roller 31 through a contact location where the belt is in contact with the outer circumferential surface of the fixing roller 31.

<Configuration of Attaching/Detaching Fixing Roller>

In the present embodiment, the fixing roller 31 is attached to the body frames 79*a* and 79*b* of the fixing apparatus 12 so as to be easily replaceable. That is, the shaft 31*a* of the fixing roller 31 is positioned and held on the body frames 79*a* and 79*b* of the fixing apparatus 12 so as to be rotatable around its axis and movable to the pressure roller 32 side.

Specifically, the shaft 31*a* on both ends of the fixing roller 31 is supported by bearings 31*b* attachable to/detachable from the body frames 79*a* and 79*b* of the fixing apparatus 12. The body frames 79*a* and 79*b* are provided with bearing guides 34 that hold the bearings 31*b* so that the bearings are attachable/detachable.

The bearing guide 34 is formed in a U shape in a side view when viewed from the axial direction of the fixing roller 31 so that the bearing 31*b* is engageably inserted into the bearing guide 34. The bearing guide 34 is provided on the body frames 79*a* and 79*b* so that the direction in which the U shape opens faces the pressure roller 32 side, where pressure is applied.

Further, the bearing guide 34 is provided with a holding member 35 that positions and holds the bearing 31*b* in the bearing guide 34, and also allows the bearing 31*b* to move toward the pressure roller 32 side. Specifically, the holding member 35 is an elastic member (here, a plate spring) that correctly positions and holds the bearing 31*b* such that the bearing can be easily detached by a person such as an operator. Accordingly, it is possible to easily perform an operation to replace the fixing roller 31.

The plate spring 35 is formed so as to hold the bearing 31*b* in an attachable/detachable manner in a state in which the bearing 31*b* is engageably inserted into the bearing guide 34. Specifically, the plate spring 35 is formed in a doglegged shape in a side view when viewed from the axial direction of the fixing roller 31. One end of the plate spring 35 is supported by the bearing guide 34 such that the bearing 31*b* is held inside the bearing guide 34 by an inclined surface of the doglegged shape abutting against the bearing 31*b* in a state in which the bearing 31*b* is engageably inserted. The plate spring 35 having such a configuration can elastically deform when the bearing 31*b* passes, and returns to the original shape after the bearing has passed. Consequently, it is possible to allow the shaft 31*a* of the fixing roller 31 to be attached to/detached from the bearing guide 34 while holding the shaft 31*a* via the bearing 31*b*.

Here, since the fixing apparatus 12 is configured so that the external heating apparatus 300 presses the fixing roller 31 from the opposite side to the pressure roller 32 with the pressing force F3, and also the fixing roller 31 is allowed to move toward the pressure roller 32 side, when the pressure cancellation apparatus 200 described above cancels the first pressing force F1 applied by the pressure roller 32 against the fixing roller 31, the fixing roller 31 moves toward the pressure roller 32 due to the pressing force F3 applied by the external heating apparatus 300. Thus, the pressure (the second pressing force F2) between the fixing roller 31 and the pressure roller 32 that is expected to be appropriately cancelled is stronger than the pressure that should be cancelled. This can cause the occurrence of an irregularity in transporting a recording sheet such as an envelope, for example.

[Description of the Present Embodiment Corresponding to Characteristic Portion of the Present Invention]

In view of this, the fixing apparatus 12 according to the present embodiment includes a regulation member 400. The regulation member 400 regulates the amount of pressure the external heating apparatus 300 applies to the fixing roller 31 when the pressure cancellation apparatus 200 cancels pressure applied by the pressure roller 32 against the fixing roller 31.

Specifically, the regulation member 400 is configured with an engaging member 410 provided on the external heating apparatus 300 side and a latching member 420 provided on the fixing apparatus 12 body side. The engaging member 410 can be an engaging protruding member that protrudes in the axial direction of the fixing roller 31. Also, the latching member 420 can be a latching member that has a latching portion that latches the engaging member 410 to a fixing roller 31 side edge portion. Note that the surface of the engaging member with which the latching portion of the latching member is in contact may be a flat surface, or may be a convex curved surface (for example, a member such as a pin or a roller). Further, a latching portion may be provided to an external heating apparatus, and an engaging unit may be provided to a fixing apparatus body side.

Specifically, the engaging member 410 protruding outward in the axial direction of the fixing roller 31 is provided, to the side frame 311 of the external heating apparatus 300, on an imaginary straight line that passes through the pivotal shaft 312*a* provided to the external heating apparatus 300 and the rotational center of the fixing roller 31. Here, the engaging member 410 is the engaging protruding member on the external heating apparatus 300 side. The body frames 79*a* and 79*b* of the fixing apparatus 12 are positioned further toward the outside than the external heating apparatus 300 in the roller axis direction. The body frames 79*a* and 79*b* are provided with through-holes 79*a*' and 79*b*', from which the engaging member 410 can protrude, and that latch the protruding engaging member 410 to fixing roller 31 side edge portions 79*a*" and 79*b*". Here, the body frames 79*a* and 79*b* provided with the through-holes 79*a*' and 79*b*' are the latching members 420 on the fixing apparatus 12 body side.

Figure 12:
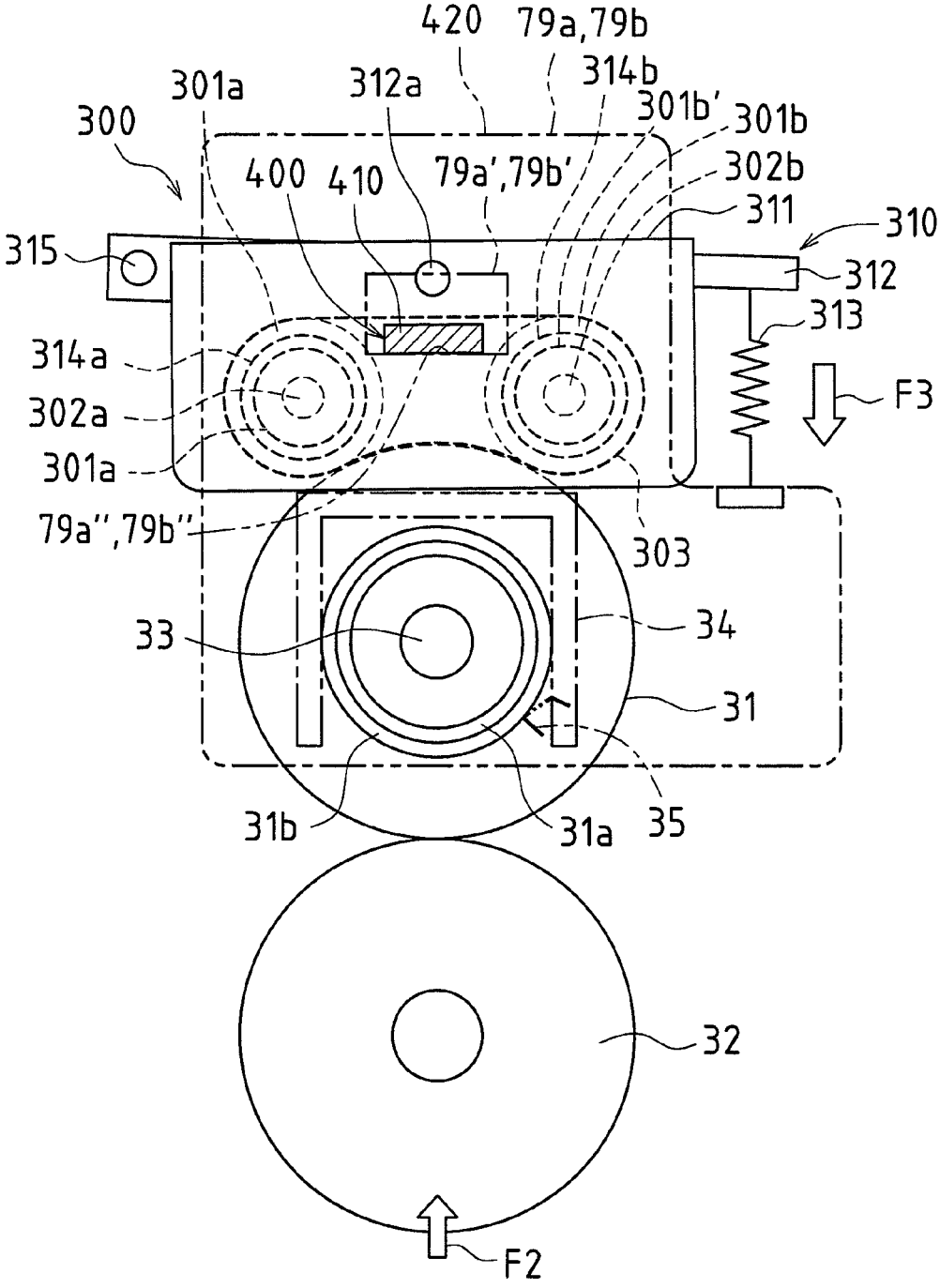
FIG. 12 is a diagram showing a state in which a regulation member regulates the amount of pressure the external heating apparatus applies in a state in which the external heating apparatus presses the fixing roller, and also, the pressure cancellation apparatus cancels pressure applied by the pressure roller against the fixing roller in the fixing apparatus according to this embodiment.

FIG. 12 shows a state in which the regulation member 400 regulates the amount of pressure the external heating apparatus 300 applies in a state in which the external heating apparatus 300 presses the fixing roller 31, and also, the pressure cancellation apparatus 200 cancels pressure applied by the pressure roller 32 against the fixing roller 31. Note that the pressing force F3 applied by the external heating apparatus 300 against the fixing roller 31 is smaller than the first pressing force F1 applied by the pressure roller 32 against the fixing roller 31 and is greater than the second pressing force F2 applied by the pressure roller 32 against the fixing roller 31. Further, a holding force with which the holding member 35 holds the bearing 31*b* is smaller than the second pressing force F2.

In the fixing apparatus 12 according to the present embodiment, even when the pressure cancellation apparatus 200 cancels pressure applied by the pressure roller 32 against the fixing roller 31, so that there is a change from the state in which the external heating apparatus 300 presses the fixing roller 31 with the pressing force F3, and also, the pressing apparatus 100 presses the pressure roller 32 against the fixing roller 31 with the first pressing force F1, as shown in FIG. 11, to a state in which the pressure roller 32 presses with the second pressing force F2, as shown in FIG. 12, the regulation member 400 can regulate the amount of pressure the external heating apparatus 300 applies to the fixing roller 31. That is, even with the configuration that allows the fixing roller 31 to move toward the pressure roller 32 side as in the present embodiment, when the pressure cancellation apparatus 200 cancels pressure applied by the pressure roller 32 against the fixing roller 31, the regulation member 400 can restrict the fixing roller 31 from moving toward the pressure roller 32 side due to the external heating apparatus 300. Thus, the pressure between the fixing roller 31 and the pressure roller 32 can be made approximately the second pressing force F2 (a pressing force substantially appropriate for performing fixing on a recording sheet such as an envelope). Accordingly, it is possible to suppress the occurrence of an irregularity in transporting a recording sheet such as an envelope.

Note that, when the pressure cancellation apparatus 200 cancels pressure applied by the pressure roller 32 against the fixing roller 31, the amount of movement of the external heating apparatus 300, which is regulated by the regulation member 400, is preferably reduced as much as possible. Alternatively, a configuration may be adopted in which when pressure is cancelled, the external heating apparatus 300 is not allowed to move.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A fixing apparatus, comprising:

a fixing roller;

a pressure roller;

a pressing unit for pressing the pressure roller toward the fixing roller;

a pressure cancellation unit for cancelling pressure applied by the pressing unit to the pressure roller against the fixing roller;

an external pressing unit for pressing the fixing roller from outside on an opposite side to the pressure roller; and a regulation member that regulates the amount of pressure the external pressing unit applies to the fixing roller;

wherein the fixing roller and the pressure roller are capable of taking either a first state or a second state;

in said first state, the pressing unit pressing the pressure roller toward the fixing roller, and fixing is made by a predetermined first pressing force;

in said second state, the pressure cancellation unit cancelling pressure applied by the pressing unit to the pressure roller against the fixing roller, and fixing is made by a predetermined second pressing force that is weaker than the predetermined first pressing force; and the regulation member, in the second state, regulates the amount of pressure that the external pressing unit applies to the fixing roller;

wherein the external pressing unit is provided as an external heating apparatus including a plurality of support rollers being arranged parallel to the axial direction of the fixing roller, heat sources being provided inside at least one of the plurality of support rollers, a heat belt being stretched between these support rollers and a second pressing unit pressing the support rollers toward the fixing roller; and wherein the regulation member is configured with an engaging member being provided on the external heating apparatus and a latching member being provided on a fixing apparatus body, the engaging member engaging the latching member in a state of making contact with each other.

2. The fixing apparatus according to claim 1, wherein the engaging member is a protruding member protruding in the axial direction of the fixing roller.

3. The fixing apparatus according to claim 2, wherein the second pressing unit comprises a side frame rotatably supporting the support rollers, the side frame is swingably supported around a pivotal shaft that is provided in the external heating apparatus and parallel to the axial direction of the fixing roller, and the protruding member is located on an imaginary straight line that passes through the pivotal shaft and the rotational center of the fixing roller.

4. An image forming apparatus, comprising the fixing apparatus according to claim 1.

5. A fixing apparatus, comprising:

a fixing roller;

a pressure roller;

a pressing unit for pressing the pressure roller toward the fixing roller;

a pressure cancellation unit for cancelling pressure applied by the pressing unit to the pressure roller against the fixing roller;

an external pressing unit for pressing the fixing roller from outside on an opposite side to the pressure roller; and a regulation member that regulates the amount of pressure the external pressing unit applies to the fixing roller;

wherein the fixing roller and the pressure roller are capable of taking either a first state or a second state;

in said first state, the pressing unit pressing the pressure roller toward the fixing roller, and fixing is made by a predetermined first pressing force;

in said second state, the pressure cancellation unit cancelling pressure applied by the pressing unit to the pressure roller against the fixing roller, and fixing is made by a predetermined second pressing force that is weaker than the predetermined first pressing force; and the regulation member, in the second state, regulates the amount of pressure that the external pressing unit applies to the fixing roller;

wherein the external pressing unit is provided as an external heating apparatus including a plurality of support rollers being arranged parallel to the axial direction of the fixing roller, heat sources being provided inside at least one of the plurality of support rollers, a heat belt being stretched between these support rollers and a second pressing unit pressing the support rollers toward the fixing roller; and wherein the regulation member is configured with a latching member being provided on the external heating apparatus and an engaging member being provided on a fixing apparatus body, the latching member engaging the engaging member in a state of making contact with each other.

6. The fixing apparatus according to claim 5, wherein the engaging member is a protruding member protruding in the axial direction of the fixing roller.

7. The fixing apparatus according to claim 6, wherein the second pressing unit comprises a side frame rotatably supporting the support rollers, the side frame is swingably supported around a pivotal shaft that is provided in the external heating apparatus and parallel to the axial direction of the fixing roller, and the protruding member is located on an imaginary straight line that passes through the pivotal shaft and the rotational center of the fixing roller.

8. An image forming apparatus, comprising the fixing apparatus according to claim 5.

* * * * *